United States Patent [19]

Selles et al.

[11] Patent Number: 4,905,918

[45] Date of Patent: Mar. 6, 1990

[54] PARTICLE PULVERIZER APPARATUS

[75] Inventors: Donald C. Selles, Brandon; Marc C. Lauderdale, Madison, both of Miss.

[73] Assignee: Ergon, Inc., Jackson, Miss.

[21] Appl. No.: 199,771

[22] Filed: May 27, 1988

[51] Int. Cl.[4] ..... B02C 19/06

[52] U.S. Cl. ..... 241/39; 241/41; 241/80; 241/79.1

[58] Field of Search ..... 241/80, 97, 119, 79.1, 241/5, 39, 40, 24, 41

[56] References Cited

U.S. PATENT DOCUMENTS

| | | | |
|---|---|---|---|
| 2,596,088 | 5/1952 | Trost et al. | 241/39 |
| 4,579,288 | 4/1986 | McDermid et al. | 241/39 |
| 4,602,743 | 7/1986 | Nied | 241/39 X |
| 4,611,764 | 9/1986 | Harsanyi et al. | 241/39 |

FOREIGN PATENT DOCUMENTS

| | | | |
|---|---|---|---|
| 1061 | 12/1984 | South Africa . | |
| 1838 | 12/1985 | South Africa . | |
| 1839 | 12/1985 | South Africa . | |
| 3488 | 12/1985 | South Africa . | |
| 1057111 | 11/1983 | U.S.S.R. | 241/5 |
| 1162487 | 6/1985 | U.S.S.R. | 241/5 |

*Primary Examiner*—Mark Rosenbaum
*Attorney, Agent, or Firm*—Larson and Taylor

[57] ABSTRACT

Pulverizer apparatus is provided for pulverizing solid materials into very fine particles. A cylindrical shell member within the pulverizer housing devides the interior of the housing into central and outer chambers therebetween. A cap disposed above a frusto-conical upper portion of the shell includes a bottom portion closing off the top of the shell and a downwardly depending frusto-conical portion. The latter is mounted in spaced, at least partially overlapping relationship with the upper portion of the shell so as to define a downwardly inclined passageway which opens into the outer chamber. A nozzle assembly, located near the bottom of the housing, produces a plurality of jets of air directed radially inwardly towards the center of the central chamber at an angle such that particles of a material located at the bottom of the central chamber are caused to rise and to impact upon each other so as to provide pulverization thereof. The particles reaching the bottom of the cap are caused to travel downwardly along the passageway and to exit into the outer chamber whereat lighter particles rise in the outer chamber and exit through the housing outlet and heavier particles drop down within the outer chamber for recirculation.

16 Claims, 3 Drawing Sheets

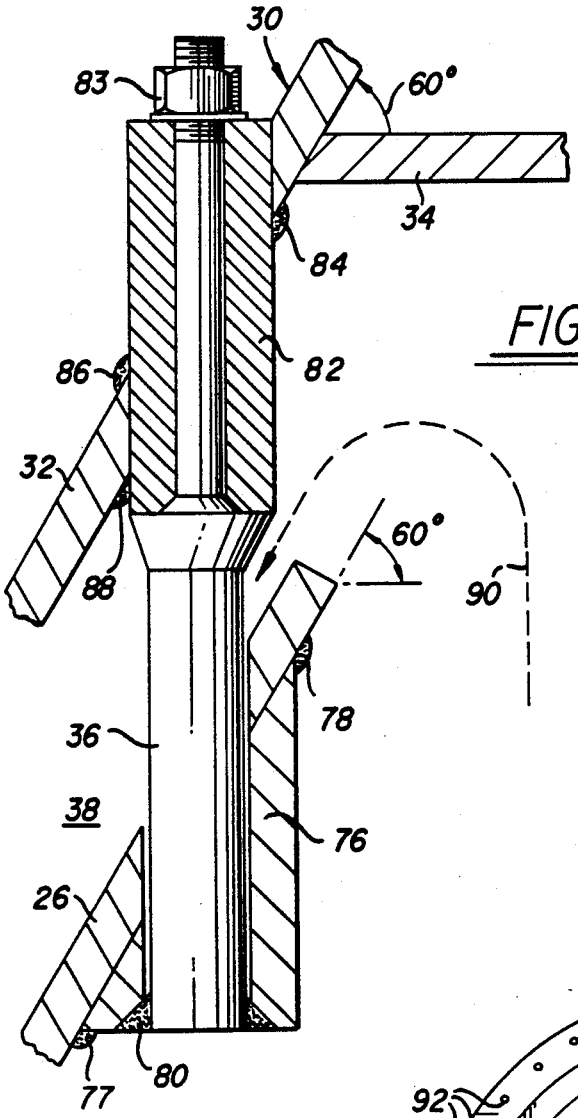
FIG. 2
FIG. 3
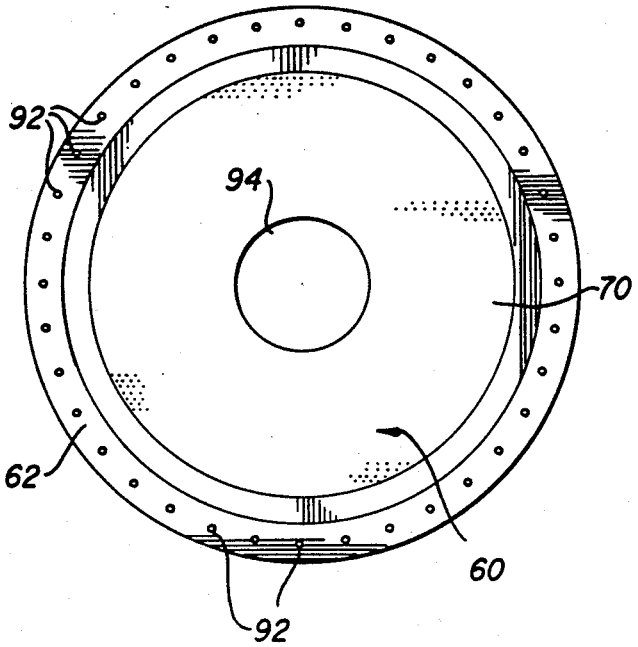
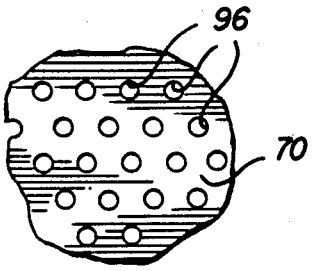
FIG. 4

FIG. 5
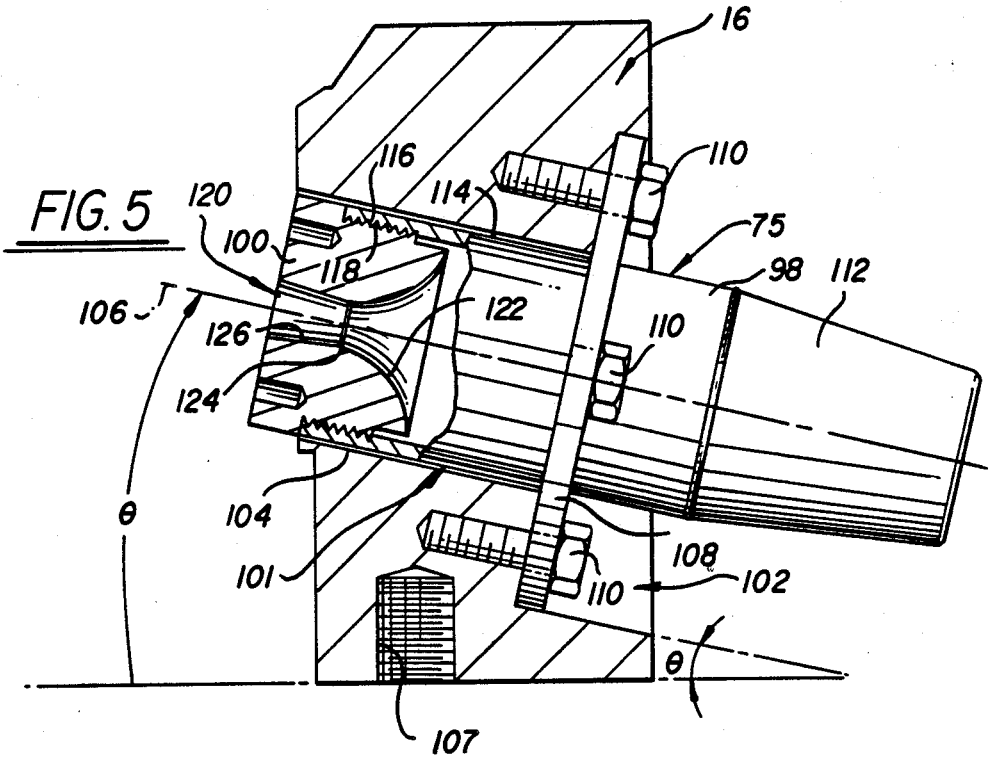
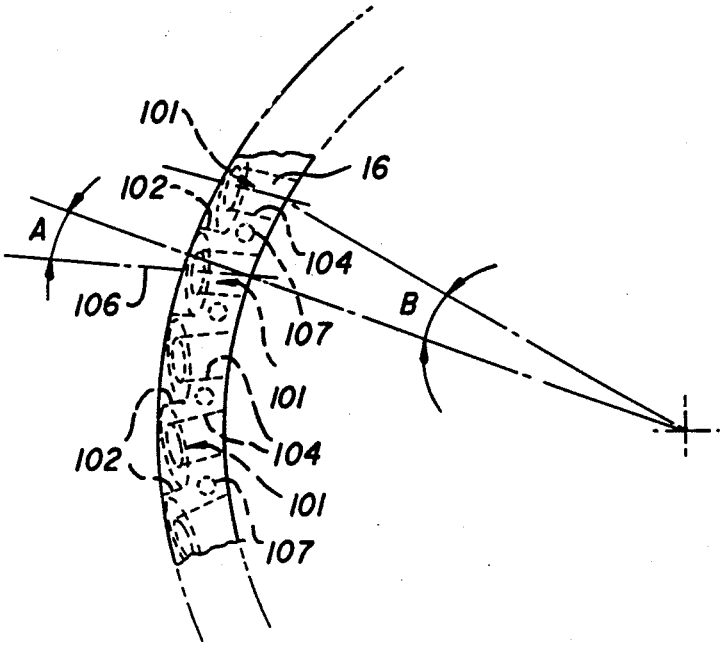
FIG. 6

PARTICLE PULVERIZER APPARATUS

FIELD OF THE INVENTION

The present invention relates to pulverizer apparatus for pulverizing materials such as coal, minerals and the like into very small "micronized" particles.

BACKGROUND OF THE INVENTION

A number of different processes and systems are available for grinding or pulverizing solid materials such as coal, minerals and the like. One system of particular interest here is that disclosed in U.S. Pat. No. 4,579,288 (McDermid et al), the subject matter of which is hereby incorporated by reference. The McDermid et al patent discloses a pulverizer for pulverizing solid materials such as coal including a plurality of jet nozzles which direct high speed jets of air into a chamber so as to cause particles contained within the chamber to impact against each other to provide pulverization. A central "sleeve" mounted in the chamber divides the chamber into an inner central cylindrical chamber and an outer annular chamber, and with this arrangment, some of the heavier particles which rise upwardly within the inner chamber with the air currents created by the jets of air fall downwardly into the outer chamber to be re-entrained by the jet nozzles and recirculated for further pulverization. A further, similar pulverizer apparatus of interest is that disclosed in U.S. Pat. No. 4,553,704 (Wilson et al) while South African Patent No. 84/1061 also discloses similar subject matter. In addition, U.S. Pat. No. 4,219,164 discloses an earlier apparatus of this type. Other patents of more general interest include: South African Pat. No. 85/3488, relating to method and apparatus for operating a metallurgical furnace using pulverized fuel; South African Pat. No. 85/1838 relating to a method of operating a coal burner using pulverized coal; and South African Pat. No. 85/1839 relating to a coal burner assembly for burning ultrafine pulverized coal.

As discussed below, an important application of the pulverizer of the invention concerns production of ultrafine coal particles for use as an alternate fuel in oil or gas-fired boilers, and the literature in this field includes *Progress Report on Dry Micronized Coal Application in a Gas-Fired Boiler*, Koeroghlian; Industrial Power Conference; Chicago Ill., 1985.

SUMMARY OF THE INVENTION

In accordance with the present invention, a pulverizer apparatus is provided which possesses a number of important advantages. Briefly considering some of these advantages, the apparatus of the invention is very rugged and durable and can basically operate continuously, as required, with greatly reduced downtime and need for servicing, because of the low wear resulting from the fact that the pulverizing apparatus itself has no moving parts. The apparatus is also very safe owing to a number of factors, including the low pressures required, the elimination of the need for inventory (e.g., the large piles of coal particles associated with conventional pulverizers) and the substantially dust-free operation provided. The health and safety advantages of a dust free environment are self-evident and as discussed in more detail below, the elimination of inventory eliminates problems caused by the substantially lowered ignition temperatures associated with aged coal.

A key advantage of the apparatus of the invention is that the particle size of the resultant pulverized product is very small, e.g., typically having a mean size of less than 12 microns and a median size of less than 10 microns. This very small, "micronized" particle size is, for example, of particular advantage where coal particles are to be used in a boiler or furnace designed for other than coal firing. The many benefits and advantages of such "micronized" particles in this environment include the following: a higher ratio of surface area to mass of the particles, a faster release of volatiles, a faster release of oxides of sulfur ($SO_x$), lower generation of nitrogen oxides ($NO_x$), smaller char particle size, high carbon conversion efficiency, small defined flame, small ash size, faster cooling of ash and a lack of stickiness thereof, easier removal of ash from furnace walls, and improved flow of ash whereby the ash follows the streamlines of the gaseous flow in the furnace.

These advantages are quite important although the importance, and availability, of some of these advantages, such as lower $NO_x$ generation and small defined flame, are dependent on the actual burner design.. To briefly explain the significance of some of these advantages, the first stage of combustion of coal particles involves burning the so-called volatiles contained in the coal, i.e., carbon in gaseous form and hydrogen, and because of the very small particle sizes involved, a vast release of volatiles is provided over a large surface area as compared with mass, so that burning takes place extremely rapidly, at a rate that is even comparable with the burning rate of a drop of oil. The result of the release of volatiles is char and because of the very small particle size and the very large ratio of surface area to mass, the char also burns very rapidly. Further, because the char particle burns so quickly and cools rapidly, the resulting ash particle is not sticky and thus will not adhere to tube or wall surface upon striking the same. This is a major advantage because ash buildup, in the form of a glassy residue, as results from conventionally ground coal on a surface is extremely difficult to remove and thus presents a serious problem. Further, because the ash particles are so small, they tend to follow the air stream within the boiler without fouling or bridging over the heat transfer surfaces and thus simply exit the boiler.

In accordance with a first important embodiment of the invention, a pulverizer apparatus is provided for pulverizing materials such as coal into very fine particles wherein the apparatus comprises a housing including an inlet for the material to be pulverized and an outlet in an upper wall thereof through which the pulverized material exits; means, located within the housing, for defining therein a central chamber in communication with the housing inlet, an outer chamber in communication with the housing outlet and a downwardly inclined passageway between an upper portion of the central chamber and the outer chamber for interconnecting the central chambers; and means for creating a vortex of air above particles of the material to be pulverized located in the central chamber at the bottom of the housing such that the particles of the material are caused to rise up in the central chamber upon being entrained in the vortex and impact on each other to provide pulverization thereof, and such that the particles are caused to exit the central chamber through the passageway and to separate in the outer chamber, after exiting from the passageway, into relatively light particles which rise in the outer chamber and exit through the outlet opening and relatively heavy particles which drop down in the outer chamber. As explained in more detail below, the provision of a downwardly inclined passageway enhances the separation of the light particles from the heavier particles and thus ensures the particles actually delivered to the outlet opening are of a very small size.

In a preferred embodiment of the invention, the chamber defining means comprises a cylindrical shell member having a frustro-conical top portion and a cap mounted on said top portion in spaced, at least partially overlapping, relationship therewith so as to define the downwardly directed passageway therebetween. Advantageously, the downwardly inclined passageway comprises a frusto-conically shaped annulus. In a specific, presently preferred embodiment, the downwardly inclined passageway comprises a frustro-conically shaped annulus whose sides form an angle of approximately 50° to 75° with the horizontal.

In accordance with a further important aspect of the invention, the central chamber includes a perforated bottom member and the apparatus further comprises air supply means disposed beneath the perforated bottom member for producing a fluidized bed of the particles at the bottom of the central chamber. As discussed in more detail below, the provision of such a fluidized bed provides important advantages in many applications, particularly with respect to economy of operation.

According to yet another important aspect of the invention, the inlet to the housing is constituted by a vertical feed tube located centrally of the central chamber at the bottom thereof and including a screw type feed conveyor disposed therein. A horizontal feed tube is connected to the vertical feed tube and extends laterally thereof. The horizontal feed tube communicates with the vertical feed tube through an opening in the side of the vertical feed tube and the horizontal feed tube includes a further screw type feed conveyor disposed therein. In addition, first and second independently operable drive means are provided for driving the respective feed conveyors of the vertical and horizontal feed tubes. As is, again, explained in more detail below, this feed arrangement, in addition to providing uniform flow, acts in the manner of an "air lock" to isolate the housing chamber from the outside environment and provides for very safe and efficient handling of the material to be pulverized as well as a passive entry of material for processing.

According to a preferred embodiment of the invention, the vortex creating means comprises a plurality of air nozzles disposed in spaced relation in a ring-shaped array around the bottom of the housing. Advantageously, the shell member defining the central chamber includes at least one opening therein adjacent to the bottom thereof through which air from the air nozzles is directed. In a specific, preferred embodiment, the longitudinal center line of each of the air nozzles is disposed at an angle of between approximately 10 and 20 degrees to the horizontal. Additionally, the longitudinal center line of each of the air nozzles is also preferably disposed at an angle of approximately 10 to 20 degrees with respect to a radial line extending to that nozzle from the center of the ring shaped array of nozzles. Advantageously, each nozzle of the array comprises an inner converging portion having curved walls, an intermediate cylindrical or flat portion and an outer diverging portion having curved walls.

Other features and advantages of the invention will be set forth in, or apparent from the detailed description of preferred embodiments of the invention which follows below.

BRIEF DESCRIPTION OF THE PREFERRED EMBODIMENTS

FIG. 2 is a cross section view of a detail the pulverizer apparatus of FIG. 1 showing the mounting arrangement for a portion of the particle classifier;

FIG. 3 is a top plan view of a particle fluidizer assembly incorporated in the embodiment of FIG. 1;

FIG. 4 is a detail of the fluidizing assembly of FIG. 3;

FIG. 5 is a cross sectional view of one of the nozzle assemblies of FIG. 1; and FIG. 6 is a schematic top plan view of a portion of the nozzle assembly of FIG. 1.

DESCRIPTION OF THE PREFERRED EMBODIMENTS

Figure 1:
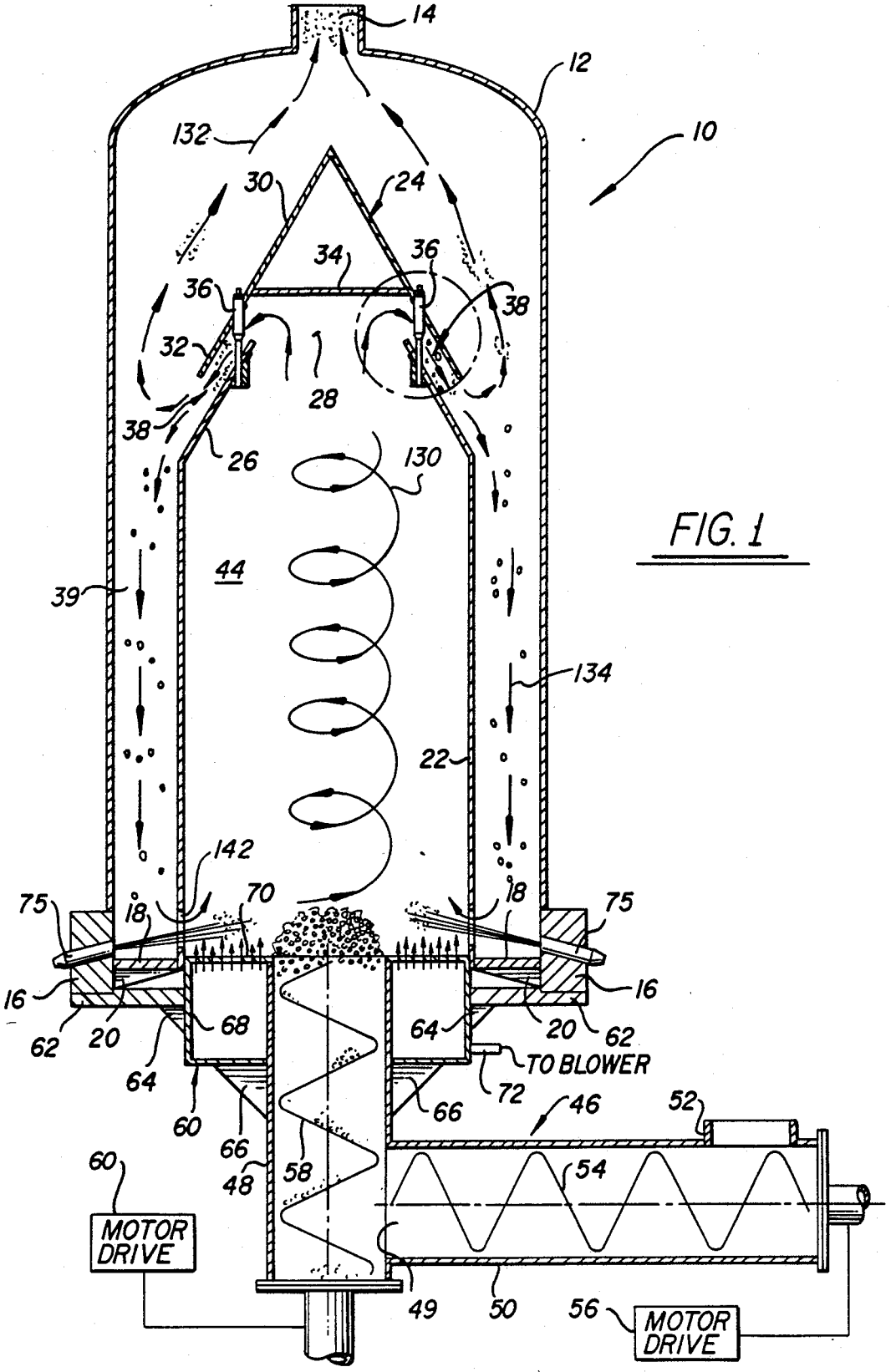
FIG. 1 is a schematic cross section view of a preferred embodiment of the pulverizer apparatus of the invention.

Referring to FIG. 1, there is shown a schematic cross section of one preferred embodiment of the pulverizer apparatus of the invention. The apparatus includes a main housing 10 of generally cylindrical shape and including a curved or rounded top portion 12 having an outlet 14 opening located centrally thereof. A nozzle ring assembly 16, described in more detail below, is disposed at the bottom of housing 10 and supported together by a support structure also described below. A support ring 18, welded to nozzle ring 16 and further supported by gussets 20, supports a central shell member 22 of an "internals" construction generally denoted 24.

Shell member or shell 22 is generally cylindrical in shape and includes an upper portion 26 in the form of a truncated cone having a central opening 28 therein. The "internals" construction 24 also includes an upper, "top hat", classifier portion 30 of generally conical shape including a downwardly depending skirt 32 and a bottom plate 34 disposed just above the upper opening 28 in shell member 22. The upper "top hat" portion 30 of construction 24 is mounted on the conical portion 26 of shell member 22 in spaced relation thereto by a support pin assembly, including a plurality of support pins 36, described below in connection with FIG. 2. Typically, three such support pins 36 are used and thus the pins are spaced apart 120°. As described in more detail below, the skirt 32 of chamber 30 and the conical portion 26 of shell 22 define an annular frusto-conical passageway 38 therebetween which causes particles exiting through opening 2 and arriving at the top plate 34 to be directed downwardly at an angle in order to exit from "internals" construction 24 into the outer annular space 39 defined between construction 24 and housing 10. Shell member 22 further includes openings 42 at the bottom or lower end thereof in registry with the air nozzles 75 of nozzle ring 16 so that, as described below, air from nozzles 42 is directed through the wall of shell 22 into the bottom of the central chamber 44 defined by shell 22.

A material feed assembly 46 feeds particles to be pulverized into the center of shell member 22. The feed assembly 46 includes vertical feed tube 48 which opens into the bottom of shell member 22 within housing 10 and horizontal feed tube 50 which is secured at one end to a side wall of vertical feed tube 48 near the bottom thereof and which is connected, at that one end,to the interior of vertical feed tube 48, through an opening 49 in that side wall. Horizontal feed tube 50 includes an inlet opening 52 at the other end thereof, and a screw conveyor 54 disposed in horizontal feed tube 50 extends longitudinally thereof so as to convey material from inlet opening 52 to the opening 49 in the side wall of vertical feed tube 48. Screw conveyor 54 is driven by a suitable motor drive indicated at 56 including a motor and gear reducer (not shown). A similar, but vertically oriented screw conveyor 58, driven by an independent motor drive 60, is disposed within vertical feed tube 48 so as to extend longitudinally (vertically) thereof.

With the feeder apparatus 46 described above, the vertical screw feeder or feed conveyor 58 receives material from horizontal screw feeder or feed conveyor 54 which displaces material already in the vertical feed tube 48. However, if the horizontal screw feeder 54 is idle, i.e., with the motor drive 56 turned off, no new material will be conveyed into housing 10 even when feeder tube 48 is completely full. Thus, vertical feeder tube 48 acts in essence as a pressure seal for the system. Further, the construction of vertical feed tube 48 assures a passive injection of material on the axis of housing 12 which is uniform throughout the full 360°.

An annular fluidizer assembly or fluidizer, denoted 60, surrounds vertical feeder tube 48 in concentric relationship thereto. Fluidizer assembly 60 includes an outwardly projecting, annular support flange 62 on which nozzle ring 16 is supported and to which nozzle ring 16 is bolted. Welded gussets 64 serve in securing and supporting the support flange 62 on fluidizer 60, and further welded gussets 66 act to secure the fluidizer 60 to the side wall of vertical feeder tube 48. Fluidizer 60 basically comprises an annular chamber 68 having a perforate upper wall 70 which constitutes the floor of chamber 44 and further includes an inlet connection 72 adapted to be connected to an air blower (not shown) for supplying air to chamber 68. Air so supplied passes through floor 70 and thus creates a fluidized bed of air above floor 70 in which particles of material delivered by feeder tube 48 are entrained prior to being carried aloft by the vortex of air created by the plurality of air nozzles 75 supported in nozzle ring 16, as is explained in more detail below.

Referring to FIG. 2, a detail of a portion of the support pin assembly of FIG. 1 is shown. As illustrated, the lower end of a pin 36 is received in pin support ring 76 which is welded to the underside of the upper frustro-conical shaped portion 26 of shell member 22 by suitable welds 77 and 78. The lower end of support pin 36 is welded in place in support pin ring 76 by a further weld 80. An upper, reduced chamber portion of support pin 36 is surrounded by a spacer 82 and extends through an opening in the depending skirt portion 32 of classifier 30. The upper end of pin 36 is suitably threaded and a hex bolt 83 is received thereon. Further tack welds 84, 86 and 88 serve to secure pin 36 and spacer 82 to skirt 32. As shown in the exemplary embodiment illustrated, the frustro-conical wall 26 and the skirt 32 form an angle of 60° with the horizontal so that a particle following the dashed line path indicated at 90 will be deflected through an angle of 120° between its initial, upward path and its path down the passage 38 defined between wall 26 and skirt 32.

Referring to FIG. 3, a top plan view of the fluidizer 60 of FIG. 1 is shown, separate from the overall pulverizer apparatus. As illustrated, support flange 62 includes a plurality of bolt holes 92 (thirty-six in an exemplary embodiment) spaced around the periphery thereof by which nozzle ring 16 is bolted to support flange 62. A central aperture 94 in perforate floor 70 is provided in alignment with a similar aperture (not shown) in the bottom wall of chamber 68 to accommodate vertical feeder tube 48.

As shown in FIG. 4, the perforate upper floor or wall 70 includes a large number of equally spaced holes 96 therein through which air supplied to chamber 68 exits to form the fluidized bed referred to above.

It is to be understood that although fluidizer assembly 60 provides important advantages in certain applications, it is also possible in other applications to eliminate fluidizer assembly 60 and to use an imperforate plate, or the like, as the bottom wall or floor of the chamber 44 defined by shell member 22. A key advantage of the fluidized bed produced by fluidizer 60 involves economy of operation. For example, assuming that compressed air is used as the grinding medium in a pulverizer not using a fluidized bed, i.e., having an imperforate floor and no blower or fan, approximately 3.4 lbs. of air for each lb. of material are required to obtain a desired particle size. With an embodiment using a fluidizing bed as described above, only approximately 2.1 lbs of compressed air for each one lb. of material are required in the presence of 1.3 lbs. of fluidizing air to produce particles of the same desired size. It will be appreciated that compressed air is very costly as compared with fluidizing air produced by a fan or blower. In this regard, compressed air can require 12.5 to 20 brake horsepower per 100 scfm while a fan or blower can deliver 100 scfm with a brake horsepower of as low as 1.35.

Referring to FIG. 5, a side elevational view, partially in cross section, is provided of one of the air nozzle assemblies 75 of FIG. 1. As illustrated in FIG. 5, each air nozzle assembly 75 basically comprises a nozzle holder 98 and an air nozzle 100 mounted in nozzle ring 16. Nozzle ring 16 includes a plurality of nozzle assembly-receiving openings 101 therein, each comprising an inclined recess 102 in the rear wall thereof which opens into an inclined aperture 104 that extends, at the same angle to horizontal, through the front wall of ring 16. More particularly, in a preferred embodiment of the invention, the common longitudinal axis 106 of the opening 101 constituted by recess 102 and aperture 104 form an angle of approximately 10 to 20 degrees with the horizontal. Nozzle ring 16 also includes a vertically extending bolt hole 107 in the bottom thereof by means of which nozzle ring 16 is bolted to support flange 62 of fluidizer assembly 60 as described above.

The nozzle holder 98 includes a support flange 108 which is received in recess 102 in abutment with the inner flat wall surface thereof, and which is bolted by bolts 110 to nozzle ring 16. Nozzle holder 98 includes a tapered or frustro-conical rear end portion 112 and a cylindrical body portion 114 which is threaded at the forward end thereof, as indicated at 116, to receive a corresponding threaded portion 118 of the associated air nozzle 100.

As illustrated, nozzle 100 includes a central opening 120 extending longitudinally thereof including a converging rear section 122 having a relatively short curvature, a very short intermediate flat (cylindrical) section 124, and a gently diverging front section 126 having an angle of divergence of approximately 3° to 5°.

As shown in FIG. 6, the nozzle receiving openings 101 of nozzle ring 16 are offset relative to, i.e., disposed at an angle, which is denoted A, of approximately 10° to 20° with respect to a radial line drawn from the center of ring 16. Because, in the exemplary embodiment under consideration, there thirty-six nozzle openings 101, the angle, denoted B, between the respective openings 101, and thus between the nozzle assemblies 75, is approximately 10°.

Considering the operation of the pulverizer of the invention as described above in connection with FIGS. 1 to 6, and referring particularly to FIG. 1, the material, such as coal, to be pulverized is initially supplied to inlet 52 of horizontal feeder tube 50 and fed therefrom to vertical feeder tube 48 by screw conveyor 54 under the control of motor drive 56. The material is then fed by vertical feeder tube 4 through the opening 94 (FIG. 3) into the bottom of chamber 44. The feeder tube 48 discharges the material so as to form a pile of the material at the bottom of chamber 49, and screw conveyor 58 ensures an equal distribution of the material around the circumference of feeder tube 48. It will be appreciated that if no material is fed to vertical feeder tube 48 by horizontal feeder tube 50, no material will be fed out of feeder tube 48 even if screw conveyor 58 is full and is being rotated by motor drive 60. Thus, as mentioned above, the feeding operation provided serves as a kind of "air lock" and so long as the pulverizing apparatus including housing 10 is air tight, the process is essentially dust-free. This is, of course, a major advantage from a number of standpoints including health and safety. Further, because the passive feeding arrangement provides a first in, first out operation, aging of the coal is not a problem. It will be understood that as coal ages it ignites at lower and lower temperatures and this can be a substantial safety hazard, particularly where a coal grinding mill includes "nooks and crannies" where coal can collect.

Fluidizer 60 provides that particles from the pile at the top of feeder tube 48 which fall onto chamber floor 70 from the pile as the pile builds are entrained in the fluidizing bed of air created by the air supplied through the holes 96 (FIG. 4) in perforate floor (wall) 70. These particles and those from the main pile itself are entrained by the jets of air produced by nozzle assemblies 75 mounted in nozzle ring 16 in spaced locations around the bottom of chamber 44 as described above. As indicated at 130 in FIG. 1 a vortex is created within chamber 44 by these jets of air and the particles impact upon one another as they rise within the vortex up chamber 44 to the top of shell 22. This impacting of the particles, one upon another, very substantially reduces the sizes of the particles as they travel to top of shell 22.

As discussed above, one very important feature of the invention involves the provision of the "internals" construction 24 as described previously for controlling the flow path of the particles. As indicated in FIG. 1, classifier 30, including bottom plate 34 and skirt 32, in cooperation with the frusto-conical portion 26 of shell member 22, causes the particles to be deflected laterally at the top of their path of travel and then to follow the inclined downward path defined by passage 38. Thereafter, the particles, upon exiting at the end of passage 38, separate into smaller lighter particles which travel upwardly as indicated by paths 132 and larger, heavier particles which fall downwardly, as indicated by paths 134, within annular space 39, to the bottom of housing 10 to be forced by the air jets of nozzle assemblies 75 through openings 42 into chamber 44 so as to be recirculated. The fact that the particles are forced to travel downwardly and thus are travelling downwardly at an inclined angle when they are permitted to separate into their lighter and heavier fractions ensures that only the lightest and hence smallest particles will travel to the top of housing 10 and exit through outlet 14, since the downward momentum of the other particles will tend to cause them to drop down within annular space 39 rather than rise up into the space adjacent "top hat" 30. In addition, the area at the exit of passage 38 is an area of relatively lower flow velocity than the high velocity flow in passage 38 so that separation of the particles is based on relative particle size. As stated above, the larger and smaller particles disengage from each other based on their size (mass) with the larger particles following the downward air stream or path 134.

Although the invention has been described relative to exemplary embodiments thereof, it will be understood by those skilled in the art that variations and modifications can be effected in the exemplary embodiments without departing from the scope and spirit of the invention.

We claim:

1. Pulverized apparatus for pulverizing material such as coal into very fine particles, said apparatus comprising:

a housing including an inlet for the material to be pulverized and an outlet in an upper wall thereof through which the pulverized material exits;

means, located within said housing, for defining therein a central chamber in communication with said inlet, an outer chamber in communication with said outlet and a downwardly inclined passageway between an upper portion of said central chamber and said outer chamber for interconnecting said central and outer chambers; and means for creating a vortex of air above particles of the material to be pulverized located in said central chamber at the bottom of said housing such that the particles of the material are caused to rise up in said central chamber in said vortex and impact on each other to provide pulverization thereof and such that the particles are caused to exit the central chamber through said passageway and to separate in the outer chamber, after exiting from said passageway, into relatively light particles which rise in the outer chamber and exit through said outlet opening and relatively heavy particles which drop down in said outer chamber;

said chamber defining means comprises a cylindrical shell member having a frusto-conical top portion and a cap mounted on said top portion, said cap including a downwardly depending frusto-conical skirt portion disposed in spaced, at least partially overlapping relationship to said frusto-conical top portion so as to define a said passageway of substantial extent therebetween, and said downwardly inclined passageway having the shape of a frusto-conically shaped annulus.

2. A pulverizing apparatus as claimed in claim 1 wherein said downwardly directed passageway comprises a frusto-conically shaped annulus whose sides form an angle of approximately 50° to 75° with respect to the horizontal.

3. A pulverizing apparatus as claimed in claim 1 wherein said vortex creating means comprises a plurality of air nozzles disposed in spaced relation in a ring-shaped array around the bottom of the housing.

4. A pulverizing apparatus as claimed in claim 3 wherein said chamber defining means includes a shell member disposed within said housing and including at least one opening therein adjacent to the bottom thereof through which air from said nozzles is directed.

5. A pulverizing apparatus as claimed in claim 4 wherein the longitudinal center line of each of said nozzles is disposed at an angle of between approximately 10 to 20 degrees to the horizontal.

6. A pulverizing apparatus as claimed in claim 5 wherein the longitudinal center line of each of said nozzles is disposed at an angle of approximately 10 to 20 degrees with respect to a radial line extending to that nozzle from the center of said ring shaped array.

7. A pulverizing apparatus as claimed in claim 3 wherein the longitudinal center line of each of said nozzles is disposed at an angle of approximately 10 to 20 degrees with respect to a radial line extending to that nozzle from the center of said ring shaped array.

8. A pulverizing apparatus as claimed in claim 1 wherein said vortex creating means comprises a plurality of nozzles, each said nozzle comprising an inner converging portion having curved walls, an intermediate cylindrical portion and an outer diverging portion having sloping walls.

9. Pulverizer apparatus for pulverizing materials to very fine particles, said apparatus comprising:

a housing including a perforated bottom member including a central inlet for the material to be pulverized, and an outlet in an upper wall thereof through which the material exits after being pulverized;

means, located with said housing, for defining therein a main chamber and an outer chamber;

means for creating a vortex flow of air within said main chamber to cause particles of the material to be fed into the main chamber through said central inlet to travel upwardly in the main chamber and to impact on each other to provide pulverization of the particles into smaller particles, and when the particles are pulverized, to provide exiting of the lighter particles through said outlet while the heavier particles drop down in the outer chamber; and air blower means, located below said perforated bottom member, for blowing air therethrough so as to create a fluidized bed of the particles at the bottom of said main chamber which assists in entraining the particles of material in said vortex flow of air.

10. A pulverizing apparatus as claimed in claim 9 wherein said chamber defining means includes passage defining means for defining a downwardly directed passage connecting said main chamber to said outer chamber for forcing particles which travel upwardly in the main chamber to the top thereof to be diverted downwardly through said passage to said outer chamber.

11. Pulverizer apparatus for pulverizing solid materials into very fine particles, said apparatus comprising:

a housing including upper, lower and side walls defining a chamber, and an inlet for the material to be pulverized and outlet in said upper wall through which the material exits after pulverization;

a shell member located in said chamber within said housing in spaced relation to said side walls of said housing so as to define a space therebetween, said shell member including a base including a frusto-conical upper portion, and a cap disposed above said frusto-conical upper portion and including a bottom portion closing off the top of the shell and a downwardly depending frusto-conical portion mounted in spaced, at least partially overlapping relationship to said upper portion of the base so as to define a downwardly directed passageway therebetween which exits into said space between the shell and the side walls of the housing; and nozzle means, located at or near the bottom of the chamber, for producing a plurality of jets of air directed radially inwardly towards the center of said chamber at an angle such that particles of a material located at the bottom of the chamber are caused to rise up within the chamber and to impinge upon each other so as to provide pulverization thereof and such that particles reaching the bottom of the cap are caused to travel downwardly along said passageway and exit into said space where at light particles rise in said space and exit through said upper outlet and heavier particles drop downwardly in said space;

said inlet being located in a lower wall of said housing centrally thereof, and said apparatus further comprising a first, vertically disposed screw conveyor for feeding material to said inlet and a second, horizontally disposed screw conveyor for feeding material to said first conveyor such that material is not fed to the chamber from the first feed conveyor unless material is being fed from the second feed conveyor to the first feed conveyor.

12. A pulverizing apparatus as claimed in claim 11 further comprising means for creating a fluidized bed of particles within said shell member at the bottom of said chamber so that particles from the fluidized bed are entrained by the jets of air produced by said nozzle means.

13. Pulverized apparatus for pulverizing material such as coal into very fine particles, said apparatus comprising:

a housing including an inlet for the material to be pulverized and an outlet in an upper wall thereof through which the pulverized material exits;

means, located within said housing, for defining therein a central chamber in communication with said inlet, an outer chamber in communication with said outlet and a downwardly inclined passageway between an upper portion of said central chamber and said outer chamber for interconnecting said central and outer chambers; and means for creating a vortex of air above particles of the material to be pulverized located in said central chamber at the bottom of said housing such that the particles of the material are caused to rise up in said central chamber in said vortex and impact on each other to provide pulverization thereof and such that the particles are caused to exit the central chamber through said passageway and to separate in the outer chamber, after exiting from said passageway into relatively light particles which rise in the outer chamber and exit through said outlet opening and relatively heavy particles which drop down in said outer chamber;

said central chamber including a perforated bottom member and said apparatus further comprising air supply means disposed beneath said perforated bottom member for producing a fluidized bed of the particles at the bottom of the central chamber; said inlet of said housing comprising a vertical feed tube located centrally within said perforated bottom member, concentrically therewith.

14. Pulverized apparatus for pulverizing material such as coal into very fine particles, said apparatus comprising:

a housing including an inlet for the material to be pulverized and an outlet in an upper wall thereof through which the pulverized material exits;

means, located within said housing, for defining therein a central chamber in communication with said inlet, an outer chamber in communication with said outlet and a downwardly inclined passageway between an upper portion of said central chamber and said outer chamber for interconnecting said central and outer chambers; and means for creating a vortex of air above particles of the material to be pulverized located in said central chamber at the bottom of said housing such that the particles of the material are caused to rise up in said central chamber in said vortex and impact on each other to provide pulverization thereof and such that the particles are caused to exit the central chamber through said passageway and to separate in the outer chamber, after exiting from said passageway, into relatively light particles which rise in the outer chamber and exit through said outlet opening and relatively heavy particles which drop down in said outer chamber;

said inlet comprising a vertical feed tube located centrally of said central chamber at the bottom thereof and including a screw type feed conveyor disposed therein.

15. A pulverizing apparatus as claimed in claim 14 further comprising a horizontal feed tube connected to said vertical feed tube and extending laterally thereof, said horizontal feed tube communicating with said vertical feed tube through an opening in the vertical feed tube located along one side thereof and said horizontal feed tube including a further screw type feed conveyor disposed therein.

16. A pulverizing apparatus as claimed in claim 15 further comprising first and second independently operable drive means for the respective feed conveyors of said vertical and horizontal feed tubes.

* * * * *